United States Patent [19]

Ishikawa

[11] Patent Number: 4,510,507

[45] Date of Patent: Apr. 9, 1985

[54] THERMAL RECORDING APPARATUS

[75] Inventor: Yuji Ishikawa, Kawasaki, Japan

[73] Assignee: Canon Kabushiki Kaisha, Tokyo, Japan

[21] Appl. No.: 516,963

[22] Filed: Jul. 25, 1983

[30] Foreign Application Priority Data

Aug. 5, 1982 [JP] Japan ..... 57-135757
Aug. 10, 1982 [JP] Japan ..... 57-137918

[51] Int. Cl.[3] ..... A05B 1/00

[52] U.S. Cl. ..... 346/76 PH; 219/216; 400/120

[58] Field of Search ..... 346/76 PH; 400/120; 219/216 PH

[56] References Cited

U.S. PATENT DOCUMENTS 3,577,137 12/1968 Brennan, Jr. ..... 346/76 PH
4,113,391 9/1978 Minowa ..... 346/76 PH
4,262,188 4/1981 Beach ..... 219/216 PH
4,284,876 8/1981 Ishibashi et al. ..... 346/76 PH

*Primary Examiner*—E. A. Goldberg
*Assistant Examiner*—A. Evans
*Attorney, Agent, or Firm*—Fitzpatrick, Cella, Harper & Scinto

[57] ABSTRACT

This invention discloses a thermal recording apparatus which is capable of providing satisfactory image quality through the control of recording pulses supplied to a thermal head, also capable of obtaining uniform recording density through the control of pulse width or voltage of recording pulses according to the level of black color of the image information, and further capable of avoiding unnatural change in the recording density within a recording sheet by conducting the control of pulse width of the recording pulses at the start or at the end of each recording operation corresponding to an original sheet.

5 Claims, 8 Drawing Figures

THERMAL RECORDING APPARATUS

BACKGROUND OF THE INVENTION

1. Field of the Invention

The present invention relates to a thermal recording apparatus for information recording with uniform recording density on a thermal recording sheet by means of a thermal head.

2. Description of the Prior Art

In a conventional thermal recording apparatus, recording pulses of a same pulse width and a same voltage are supplied to the heating elements of the thermal head for dot recording. For this reason, in the recording of a belt-shaped image information which is a number of dots the same in number as the heating elements of the thermal head, the recording density tends to become lower at the start of recording and to fluctuate along said belt according to the instantaneous black level of image information.

Such fluctuation in the recording density along the belt-shaped image recording in the conventional apparatus results from a temperature change of the substrate of the thermal head corresponding to the black level of the image information, caused by the diffusion of heat generated in the heating elements at the image recording into said substrate. In the above-mentioned case, the temperature of the substrate shows an exponential change in the directiion of said belt.

Also, continued use of the thermal recording apparatus over a prolonged period often results in damage to the thermal head, due to overheating caused by the accumulated heat.

In order to prevent such destruction of the thermal head, a temperature sensor is mounted on or in the vicinity of the thermal head for gradually regulating the recording pulse width or the recording voltage which is supplied to the thermal head in the course of the image recording.

Such temperature control of the thermal head naturally leads to a fluctuation of the recording density, and a very costly detailed control has been indispensable in order to maintain such fluctuation of the recording density on the recorded image at a level which can not visually be discerned.

SUMMARY OF THE INVENTION

A first object of the present invention is to provide a thermal recording apparatus capable of improving the quality of the information recorded on a thermal recording medium.

A second object of the present invention is to provide a thermal recording apparatus capable of providing a uniform recording density thereby avoiding an undesirable change in the recording density.

A third object of the present invention is to provide a thermal recording apparatus capable of preventing an abnormal temperature rise in the thermal head and destruction of the head resulting from such an abnormal temperature rise.

DETAILED DESCRIPTION OF THE PREFERRED EMBODIMENTS

Figure 1:
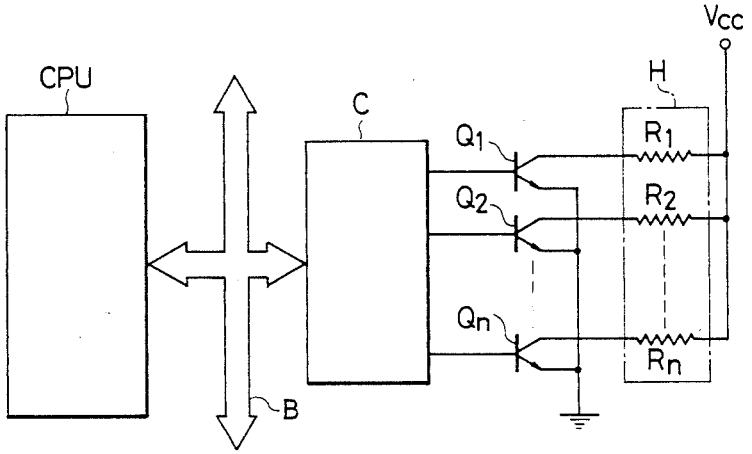
FIG. 1 is a block diagram showing a first embodiment of the thermal recording apparatus of the present invention.

FIG. 1 is a block diagram of a first embodiment of the thermal recording apparatus of the present invention, wherein shown are a microprocessor CPU; a bus line B; a picture signal control unit C; a thermal head H; head driving transistors $Q_1, Q_2, \ldots, Q_n$; resistors $R_1, R_2, \ldots, R_n$ constituting the heating elements on said thermal head; and a power supply voltage Vcc.

Figure 2:
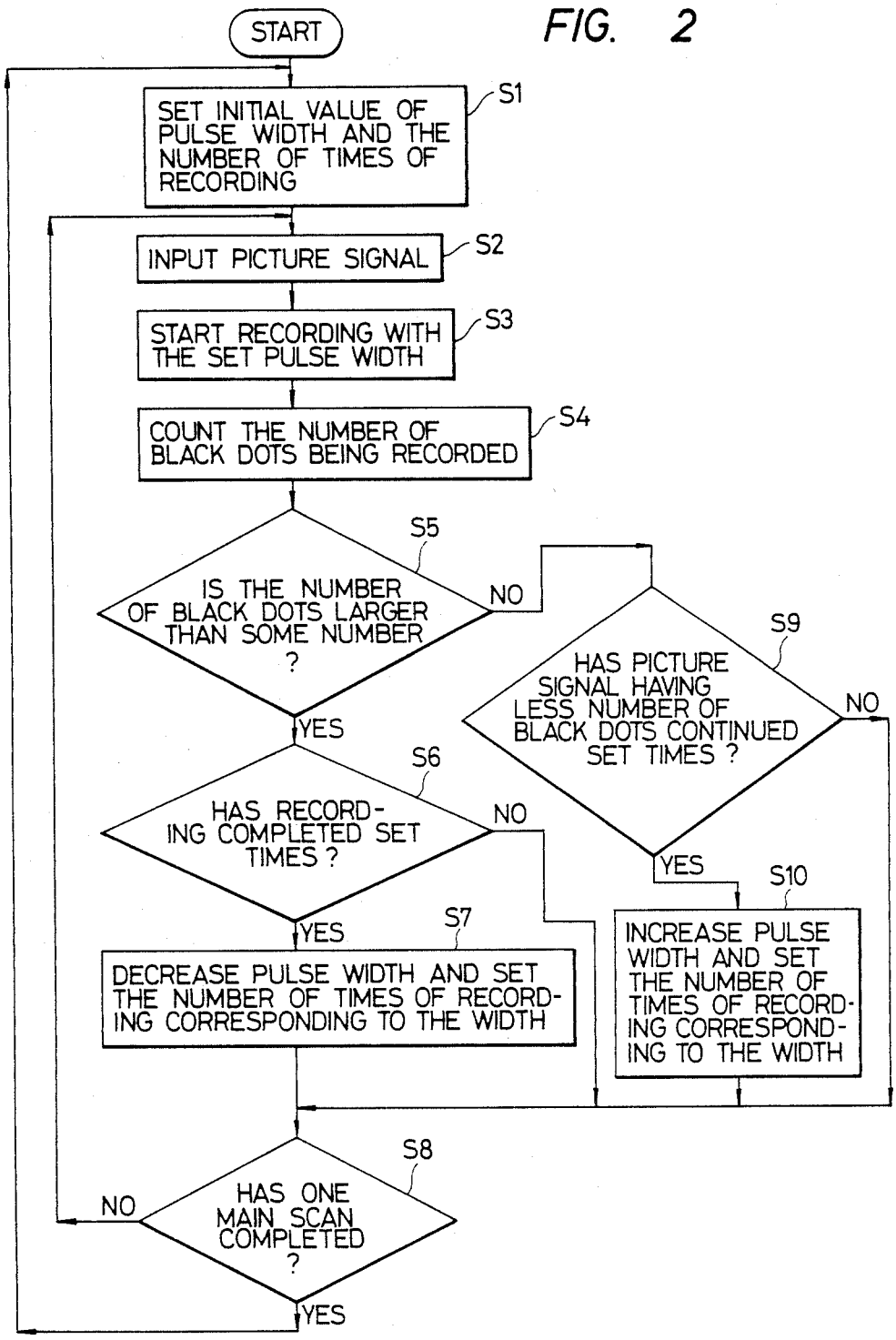
FIG. 2 is a flow chart showing the control procedure for obtaining uniform density.

In the first embodiment of the present invention shown in FIG. 1, the microprocessor CPU performs a control according to the flow chart shown in FIG. 2.

Figure 3:
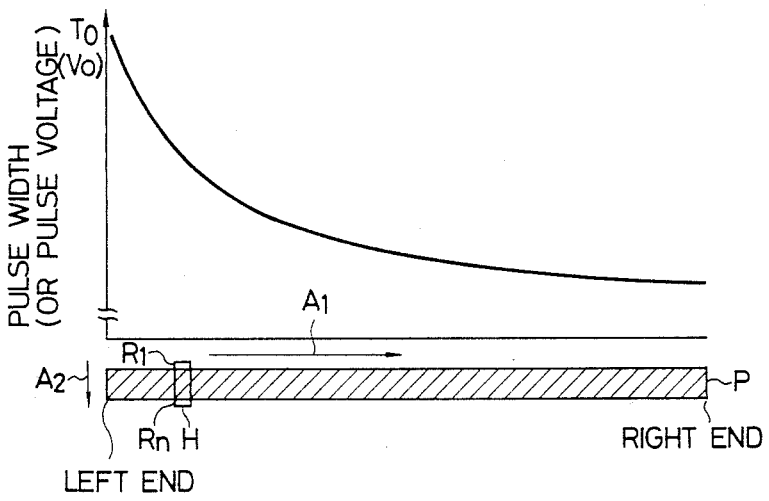
FIGS. 3 and 4 are charts showing the change in the pulse width according to the uniform density control of the present invention.
Figure 4:
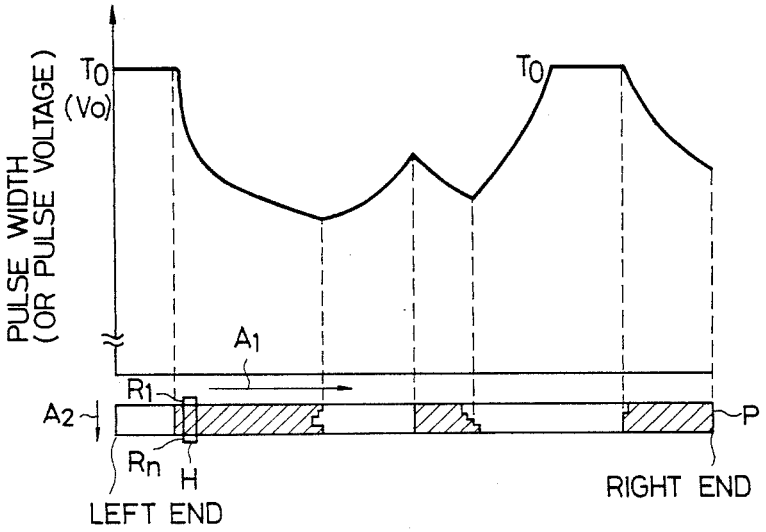

The microprocessor CPU converts the picture signals in the unit of a line, as represented by an arrow A1 in FIGS. 3 and 4, into picture signals in units of a belt, as represented by an arrow A2, and supplies the thus converted signals to the picture signal control unit C in synchronization with the movement of the thermal head in the main scanning direction represented by the arrow A1. In response to the thus supplied picture signals, the picture signal control unit C supplies the head driving transistors Q1, Q2, . . . , Qn with recording pulses of a determined width for energizing the heat generating resistors R1 - Rn of the thermal head H, thereby recording the picture information on a thermal recording sheet.

In releasing the above-mentioned recording pulses, the picture signal control unit C performs a process according to the flow chart shown in FIG. 2. At first, prior to the start of recording, a step S1 sets the initial values of the recording circuit and of the pulse width of the recording pulses to be supplied to the head driving transistors Q1, Q2, . . . , Qn. A certain number of recordings is determined in advance for each pulse width.

Then, in a step S2, the input of picture signals constituting dots of a number corresponding to the width of the belt from the microprocessor CPU to the picture signal control unit C is performed, and in step S3, the supply of recording pulses of a pulse width already determined in the step S1, from the picture signal control unit C to the head driving transistors Q1, Q2, . . . , Qn for energizing the heating elements of the thermal head is performed.

During the supply of said recording pulses, the picture signal control unit C performs the following control operations. First, in step S4 the number of black dots currently recorded is counted. If in step S5 it is determined that said number of black dots is large enough for heating the entire substrate of the thermal head, a recording is counted and the program proceeds to a step S6. If, in the step S6 it is determined that the count of recordings has reached the number of recordings determined in advance corresponding to the pulse width, the program proceeds to a step S7 for decreasing the pulse width for subsequent recording and for setting anew a recording number corresponding to the thus reduced pulse width.

On the other hand, in case the step S5 identifies that the number of black dots has not reached the pre-determined number, the program proceeds to a step S9 for counting the consecutive number of image recordings with such a lesser number of black dots. If said count exceeds a certain number, the program proceeds to a step S10 for increasing the pulse width for subsequent recording operations and for setting a recording number corresponding to the thus increased pulse width.

Upon completion of the above-described procedure, the program proceeds either from the step S7 or S10 to the step S8 for awaiting the termination of the recording pulses currently released. The recording proceeds by repeating the above-described procedure, and the initial setting of the pulse width and of the recording number is conducted at the end of each main scanning.

The changes in the pulse width and in the recording number as explained above, make it possible to achieve, in response to the exponential temperature rise of the thermal head substrate, an almost exponential control in the pulse width in the main scanning direction.

FIGS. 3 and 4 show the change in the pulse width under the uniform density control of the present invention. FIG. 3 shows the operation of the present invention; and in the recording of entirely black signals, and FIG. 4 shows its operation in the recording of signals containing both black and white. In these charts P represents the picture signals constituting a belt, and T0 represents the maximum value of the recording pulse width.

The pulse width shows an exponential decrease in case of FIG. 3, but, in case of FIG. 4, the pulse width decreases or increases respectively after continued black or white recording.

As explained in the foregoing, the present invention makes it possible to achieve a uniform recording density and to prevent overheating of the thermal head, through the regulation of the pulse width in response to the black level of the image signals to be recorded.

Although the recording pulse control in the preceding embodiment is directed to achieve a uniform density, the present invention can also be utilized for realizing a uniform density level over the entire picture. It is therefore possible to obtain a thermal recording apparatus capable of tonal recording, by means of an additional control for switching the pulse voltage or the pulse width into several steps.

Furthermore, although in the foregoing embodiment the pulse width is regulated while the pulse voltage to the thermal head is maintained constant, a same effect can be obtained by controlling the pulse voltage in a similar manner while maintaining the pulse width constant.

Figure 5:
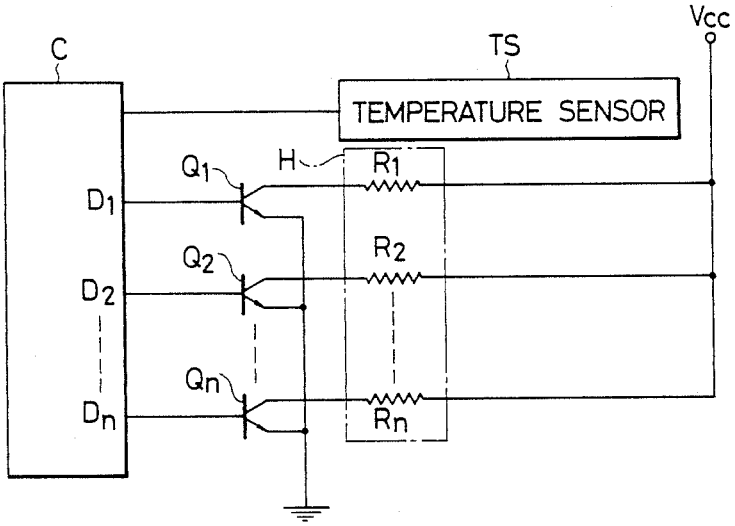
FIG. 5 is a block diagram showing a second embodiment of the thermal recording apparatus of the present invention.

FIG. 5 shows a second embodiment of the thermal recording apparatus of the present invention, wherein shown are a picture signal control unit C; picture signal controlling transistors Q1, Q2, . . . , Qn; resistors R1, R2, . . . , Rn constituting heating elements; and a thermal head H equipped with plural heating elements R1 - Rn. A temperature sensor TS is mounted on or in the vicinity of said thermal head H. D1, D2, . . . , Dn represent picture signals.

Figure 6:
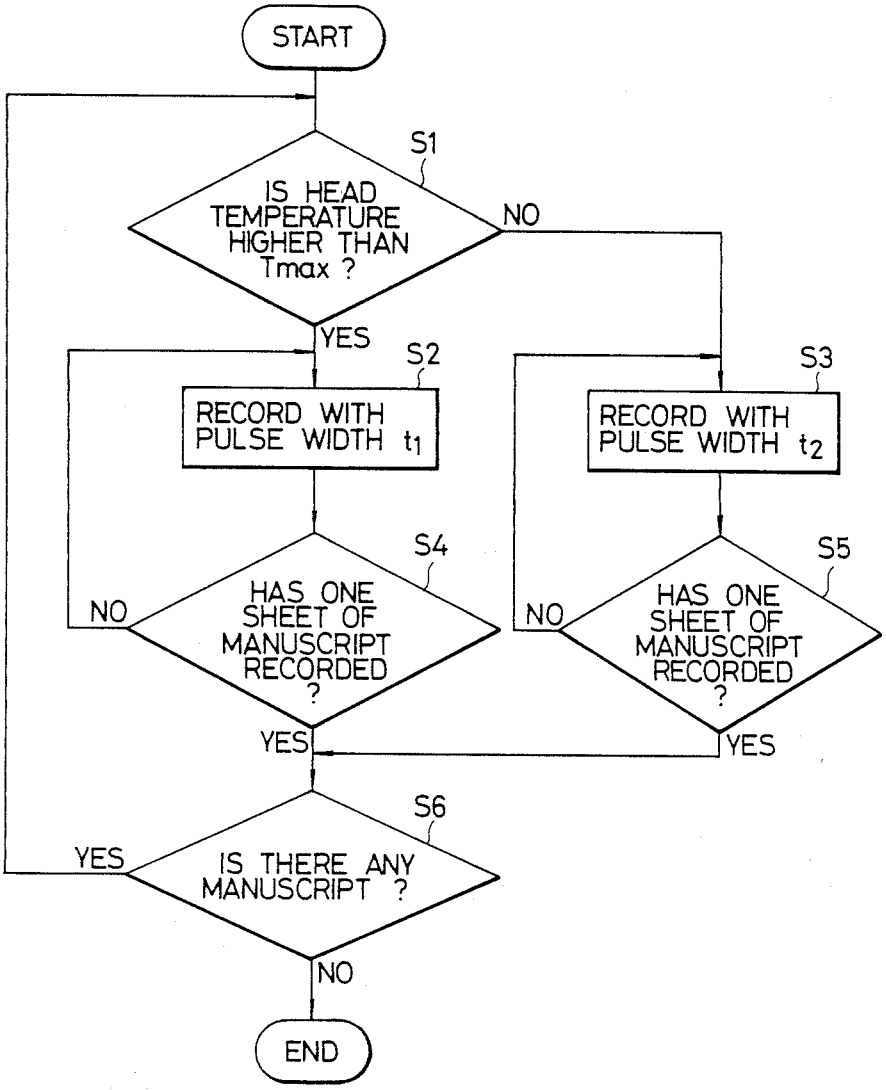
FIG. 6 is a flow chart showing the control procedure for preventing the overheating of the thermal head.

FIG. 6 is a flow chart showing the function of the picture signal control unit shown in FIG. 5, wherein Tmax represents a determined temperature for effecting overheating prevention control, t1 and t2 represent the pulse widths of the picture signals to be supplied from the picture signal control unit C to the transistors Q1 - Qn, wherein $t1<t2$.

Figure 7:
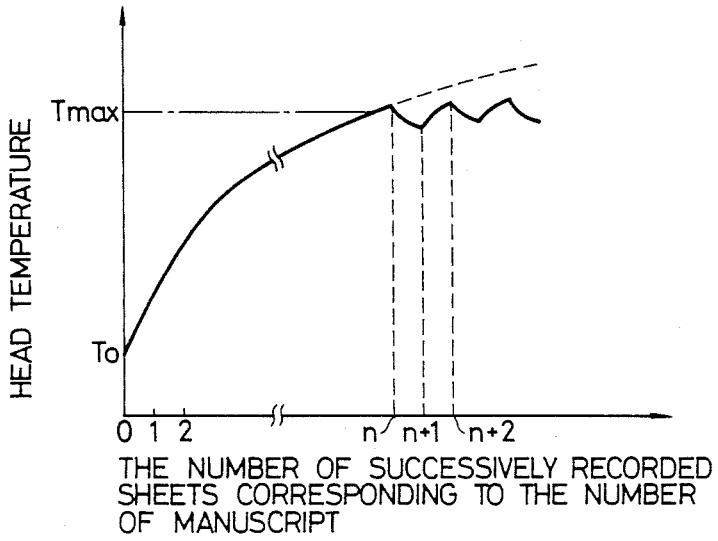
FIG. 7 is a chart showing an example of the temperature change in the thermal head at continuous recording of a plurality of originals.

FIG. 7 is a chart showing the temperature change in the thermal head under an overheating prevention control according to the present invention.

Figure 8:
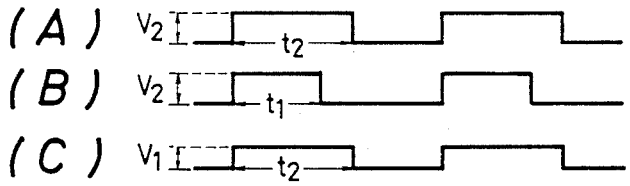
FIG. 8 is a timing chart showing picture signals $t_1$ and $t_2$ to be released from a picture signal control unit C for energizing the heating elements of the thermal head.

FIG. 8 is a timing chart showing the changes in the picture signals D1, D2, . . . , Dn supplied from the picture signal control unit C to the picture signal controlling transistors Q1, Q2, . . . , Qn under said overheating prevention control. A curve (B) shows a waveform with a reduced pulse width ($t1<t2$) in comparison with a waveform in a curve (A), and a curve (C) shows a waveform with a reduced pulse voltage ($V1<V2$) in comparison with the curve (A).

Referring to the flow chart shown in FIG. 6, prior to the start of the recording corresponding to a first original, a step S1 detects the initial temperature of the thermal head H through the temperature sensor TS. If said detected temperature is higher than the determined temperature Tmax, the program proceeds to a step S2 for conducting the recording with a pulse width t1. On the other hand, if said detected temperature is lower than the determined temperature Tmax, the program proceeds to a step S3 for recording with a pulse width t2. Said recording pulse width is maintained constant within a recorded picture.

The succeeding steps S4 and S5 identify the completion of recording corresponding to an original and terminate the recording operation. A succeeding step S6 identifies whether recording for a succeeding original is required, and, if so, the program returns to the step S1 in which the temperature of the thermal head H is again measured and the recording pulse width for the succeeding recording is likewise determined.

The above-described procedure is repeated in the case of continuous information recording.

As explained in the foregoing, the recording pulse width is shortened whenever the temperature of the thermal head H exceeds a certain determined temperature, thereby dissipating the heat accumulated in the thermal head H. Consequently the temperature reaches a stationary state around the determined temperature Tmax as shown in FIG. 7, and damage to the thermal head H can be prevented even in the case of prolonged continuous recording.

Although the preceding embodiment is designed to prevent the overheating of the thermal head through the regulation of the recording pulse width, a similar effect can also be obtained by controlling the pulse voltage supplied to the thermal head while maintaining the recording pulse width constant.

As explained in the foregoing, the present invention can achieve satisfactory prevention of the overheating of the thermal head by means of a simple circuit structure and a simple control, by inspecting the head temperature at the start of recording and regulating the pulse width or the pulse voltage. Also the present invention is effective for avoiding a sudden density change in a recorded picture.

What is claimed is:

1. A thermal recording apparatus, comprising:

a thermal head including a plurality of heating elements arranged in a first direction for recording information on a thermal recording medium; and control means for controlling said thermal head, wherein said control means (a) applies first recording pulses of a predetermined voltage and a predetermined width to said thermal head in response to input picture signals upon scanning of said plurality of heating elements in the first direction, (b) counts the number of said first recording pulses applied to said thermal head, and (c) applies to said thermal head second recording pulses, having one of the voltage and width thereof different from that of said first recording pulses, in response to the counted number of said first recording pulses when said thermal head is scanned in a second direction different from the first direction and is further scanned in the first direction.

2. A thermal recording apparatus of claim 1, wherein said control means decreases one of the voltage and the width of the second recording pulses as compared to that of the first recording pulses when the counted number of first recording pulses is greater than a predetermined number, and wherein said control means increases one of the voltage and the width of the second recording pulses as compared to that of the first recording pulses when the counted number of first recording pulses is less than the predetermined number.

3. A thermal recording apparatus, comprising:

a thermal head including a plurality of heating elements arranged in a first direction for recording information on a thermal recording medium; and control means for controlling said thermal head, wherein said thermal head (a) applies first recording pulses of a predetermined voltage and a predetermined width to said thermal head in response to input picture signals to cause said plurality of heating elements to be scanned for recording in the first direction, (b) counts the number of the first recording pulses applied to said thermal head when said thermal head is moved in a second direction different from the first direction and is further scanned for recording in the first direction, (c) applies second recording pulses to said thermal head, and (d) changes, upon completion of recording in the first direction by a predetermined number of steps in the second direction, one of the predetermined voltage and the predetermined width of the second recording pulses, in response to the number counted during the predetermined number of steps.

4. A thermal recording apparatus according to claim 3, wherein said control means decreases one of the voltage and the width of said second recording pulses as compared with that of said first recording pulses when the number counted within the predetermined steps is larger than a predetermined number, and wherein said control means increases one of the voltage and the width of said second recording pulses as compared with that of said first recording pulses when the number counted is smaller than the predetermined number.

5. A thermal recording apparatus, comprising:

a thermal head including a plurality of heating elements arranged in a first direction for recording information on a thermal recording medium;

temperature detecting means for detecting the temperature of said thermal head; and control means for controlling said thermal head by setting first recording pulses having a predetermined voltage and a predetermined width and second recording pulses having a lower voltage and a smaller width than said first recording pulses, and causing, after recording on one page by said first recording pulses in response to input picture signals, said thermal head to record on the following page by said second recording pulses when the temperature detected by said temperature detecting means is higher than a predetermined temperature and to record on the following page by said first recording pulses when the temperature detected by said temperature detecting means is lower than the predetermined temperature.

* * * * *

UNITED STATES PATENT AND TRADEMARK OFFICE

CERTIFICATE OF CORRECTION

PATENT NO. : 4,510,507

DATED : April 9, 1985

INVENTOR(S) : YUJI ISHIKAWA

It is certified that error appears in the above-identified patent and that said Letters Patent is hereby corrected as shown below:

Column 5, line 9, after "having" insert --at least--;

line 17, after "decreases" insert --at least--; and line 22, after "creases" insert --at least--.

Column 6, line 4, after "direction," insert --at least--;

line 9, after "decreases" insert --at least--;

line 14, after "increases" insert --at least--; and line 28, after "having" insert --at least one of--.

Signed and Sealed this

*Thirty-first* Day of *December 1985*

[SEAL]

*Attest:*

*Attesting Officer*

DONALD J. QUIGG

*Commissioner of Patents and Trademarks*